US006816685B2

(12) United States Patent
Eda

(10) Patent No.: US 6,816,685 B2
(45) Date of Patent: Nov. 9, 2004

(54) IMAGE FORMING APPARATUS

(75) Inventor: Noriyuki Eda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/327,916

(22) Filed: Dec. 26, 2002

(65) Prior Publication Data

US 2004/0037600 A1 Feb. 26, 2004

(30) Foreign Application Priority Data

Aug. 20, 2002 (JP) ..... 2002-239185

(51) Int. Cl.[7] ..... G03G 15/00; G03G 15/20
(52) U.S. Cl. ..... 399/16; 399/45; 399/68
(58) Field of Search ..... 399/16, 45, 43, 399/67, 68, 322, 361, 388, 397, 400

(56) References Cited

U.S. PATENT DOCUMENTS 4,595,279 A * 6/1986 Kuru et al. ..... 399/45
6,057,869 A * 5/2000 Kawaishi et al. ..... 399/68 X
6,112,037 A * 8/2000 Nagata et al. ..... 399/45
6,154,621 A * 11/2000 Yamamoto et al. ..... 399/68
6,381,422 B1 * 4/2002 Tanaka ..... 399/45
2002/0061198 A1 * 5/2002 Sameshima et al. ..... 399/68
2002/0141774 A1 * 10/2002 Nagano ..... 399/68

FOREIGN PATENT DOCUMENTS

JP 09-171277 * 6/1997
JP 2000-315027 * 11/2000
JP 2001-324890 * 11/2001

* cited by examiner

*Primary Examiner*—Sophia S. Chen
(74) *Attorney, Agent, or Firm*—Rabin & Berdo, P.C.

(57) ABSTRACT

An image recording apparatus includes an image forming section, a transportbelt, a fixing roller, a discharge roller, and a controller. The image forming section forms a toner image on a print paper. The transport belt transports the print paper onto which the toner image has been transferred. The fixing roller is disposed downstream of the transport belt with respect to a direction of travel of the print paper, and then cooperates with the discharge roller to further advance the paper toward the stacker. The controller controls the speeds of the transport belt, the fixing roller, and discharge roller. The speed of the fixing roller and discharge roller are changed relative to the speed of the transport belt in accordance with a distance from a reference position over which the print paper advanced by the fixing roller and discharge roller toward the paper stacker.

18 Claims, 10 Drawing Sheets

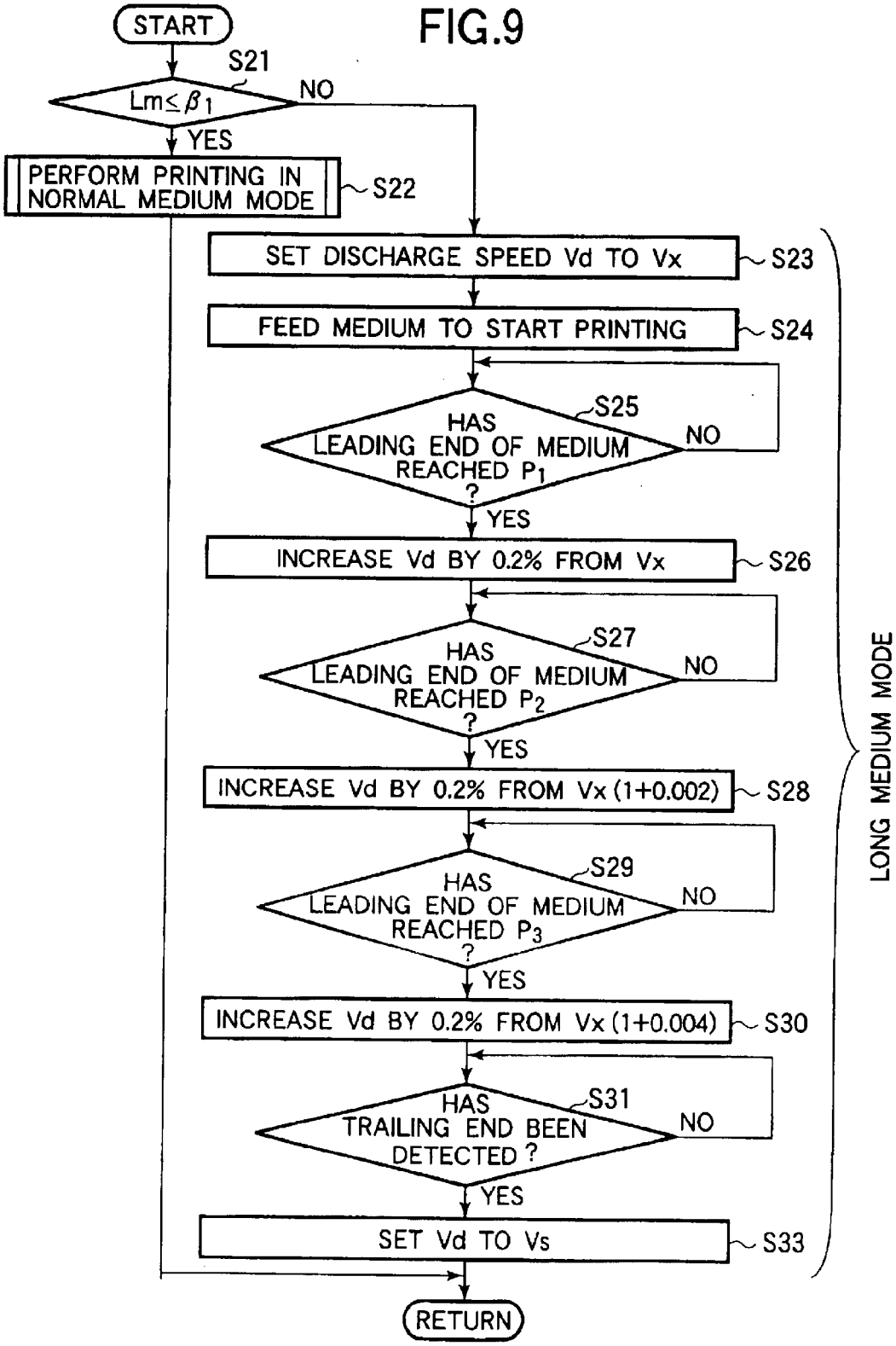
FIG.9
START
S21
Lm≤β1
NO
YES
PERFORM PRINTING IN NORMAL MEDIUM MODE
S22
SET DISCHARGE SPEED Vd TO Vx
S23
FEED MEDIUM TO START PRINTING
S24
S25
HAS LEADING END OF MEDIUM REACHED P1 ?
NO
YES
INCREASE Vd BY 0.2% FROM Vx
S26
S27
HAS LEADING END OF MEDIUM REACHED P2 ?
NO
YES
INCREASE Vd BY 0.2% FROM Vx (1+0.002)
S28
S29
HAS LEADING END OF MEDIUM REACHED P3 ?
NO
YES
INCREASE Vd BY 0.2% FROM Vx (1+0.004)
S30
S31
HAS TRAILING END BEEN DETECTED ?
NO
YES
SET Vd TO Vs
S33
LONG MEDIUM MODE
RETURN

FIG.10

| PARAMETER \ MODE | FIRST MODE | SECOND MODE | THIRD MODE |
|---|---|---|---|
| INITIAL VALUE OF SPEED RATIO | 0.9900 | 0.9955 | 0.9990 |
| RATE OF CHANGE OF SPEED RATIO | 0.30 [%] | 0.20 [%] | 0.10 [%] |
| POINT $P_1$ | 300 [mm] | 400 [mm] | 500 [mm] |
| POINT $P_2$ | 500 [mm] | 600 [mm] | 700 [mm] |
| POINT $P_3$ | 700 [mm] | 800 [mm] | 900 [mm] |

IMAGE FORMING APPARATUS

BACKGROUND OF THE INVENTION

1. Field of the Invention

The present invention generally relates to an image forming apparatus.

2. Description of the Related Art

Conventional color image forming apparatuses include printers, copying machines, and facsimile machines. A color image forming apparatus includes image-forming sections that form yellow, magenta, cyan, and black images. Image forming sections are aligned in a direction in which a medium-transporting belt runs. As the medium-transporting belt runs through the image forming sections, yellow, magenta, cyan, and black toner images are transferred onto a print medium in registration with one another to form a full color toner image on the print medium. Then, the print medium is further advanced to a fixing unit where the print medium passes between a heat roller and a backup roller so that the full color toner image is fused into a permanent full-color image.

With a conventional image recording apparatus, the medium-transport belt can advance the print medium to the fixing unit at a somewhat higher speed than the circumferential speed of the heat roller. This small difference in speed creates slack in the print medium between the heat roller and the backup roller. The amount of slack depends on the length of the print medium. A long print medium will have a significant amount of slack therein and there is a possibility of the toner image formed on the print medium touching a chassis of the fixing unit. Thus, the toner image on the print medium can be damaged with the result that print quality is low.

SUMMARY OF THE INVENTION

The present invention was made in view of the aforementioned problems.

An object of the invention is to provide an image recording apparatus in which the print medium is prevented from contacting the chassis of the fixing unit and image quality is prevented from deteriorating.

An image recording apparatus includes an image forming section, a first medium-transporting section such as transport belt, a second medium-transporting section such as fixing roller and a discharge roller, and a controller. The image forming section forms a toner image on a medium. The first medium-transporting section transports the medium onto which the toner image has been transferred. The second medium-transporting section receives the medium transported from the first medium transporting section. The second medium-transporting section further transports the medium. The second medium-transporting section is disposed downstream of the first medium-transporting section with respect to a direction of travel of the medium. A controller controls at least one of a first transport speed of the first medium-transporting section and a second transport speed of the second medium-transporting section, so that a relative speed of the first medium-transporting section and the second medium-transporting section is changed. The second transport speed is changed relative to the first transport speed in accordance with a distance from a reference position over which the medium is advanced by the second transporting section toward the stacker.

The controller sets the second transport speed higher than the first transport speed when the medium has traveled over a distance longer than a predetermined length from the reference position.

If the medium has traveled over a predetermined distance after the controller sets the second transport speed higher than the first transport speed, the controller sets the second transport speed lower than the first transport speed.

The controller determines whether the medium has a length greater than a predetermined medium length. The controller changes the second transport speed by a predetermined fraction when the medium has a length greater than the predetermined medium length.

The image recording apparatus may further include a medium detector and a counter. The medium detector is disposed in a transport path of the medium to detect the medium, and the counter that counts operation parameters of the first medium-transporting section after the medium is detected by the medium detector. The controller checks an output of the counter to determine whether the medium is longer than the predetermined medium length.

The controller sets a second transport speed higher than the first transport speed when the medium has traveled over a distance longer than a predetermined length from the reference position.

The first medium-transporting section has a transfer section that transfers the toner image onto the medium. The second medium-transporting section has a fixing section that fixes the toner image on the medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 9 is a flowchart, illustrating the medium-discharging operation according to the second embodiment;

FIG. 10 illustrates medium discharge modes according to the third embodiment.

DETAILED DESCRIPTION OF THE INVENTION

By way of example, embodiments of a recording apparatus according to the invention will be described with respect to a printer.

First Embodiment

Figure 1:
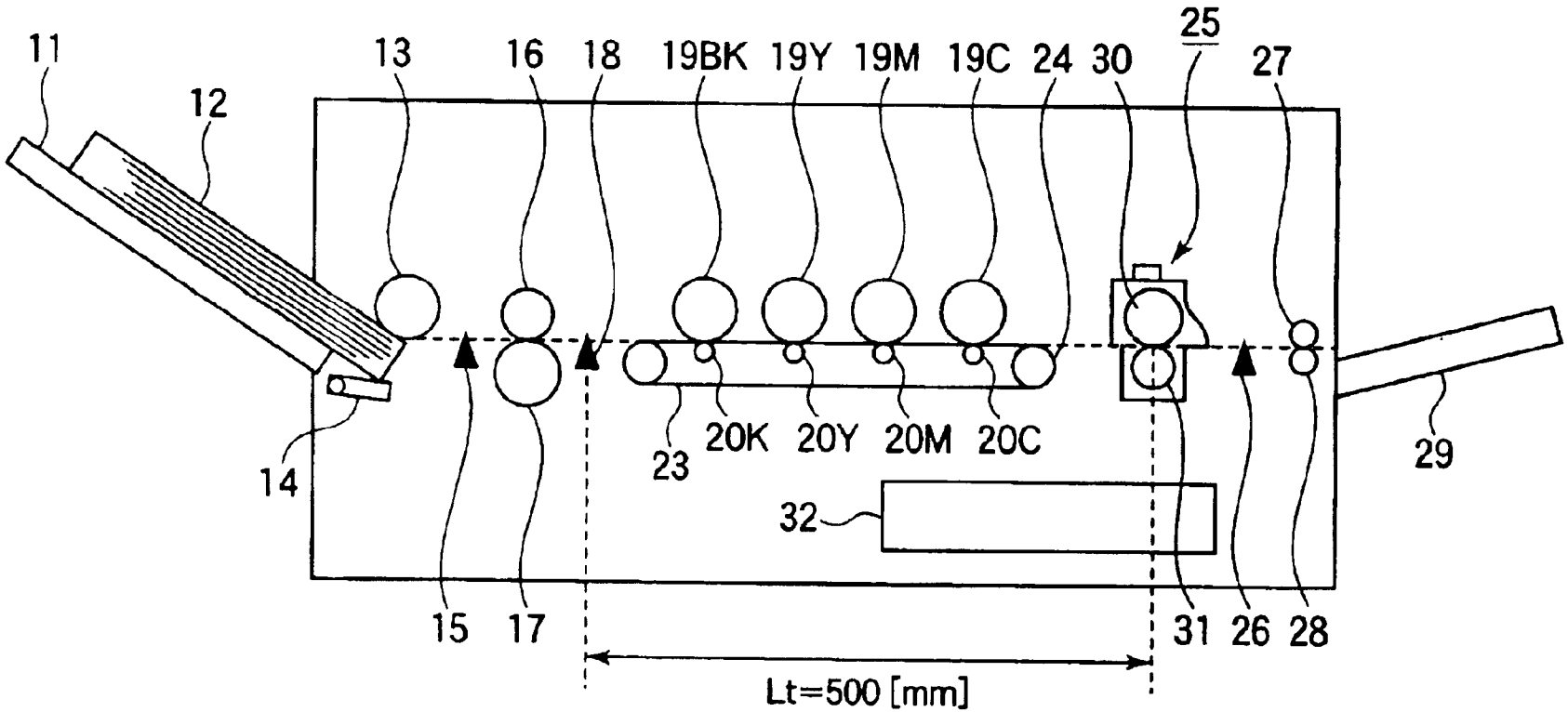
FIG. 1 illustrates a general configuration of a first embodiment.

FIG. 1 illustrates a general configuration of a first embodiment of the invention.

Figure 2:
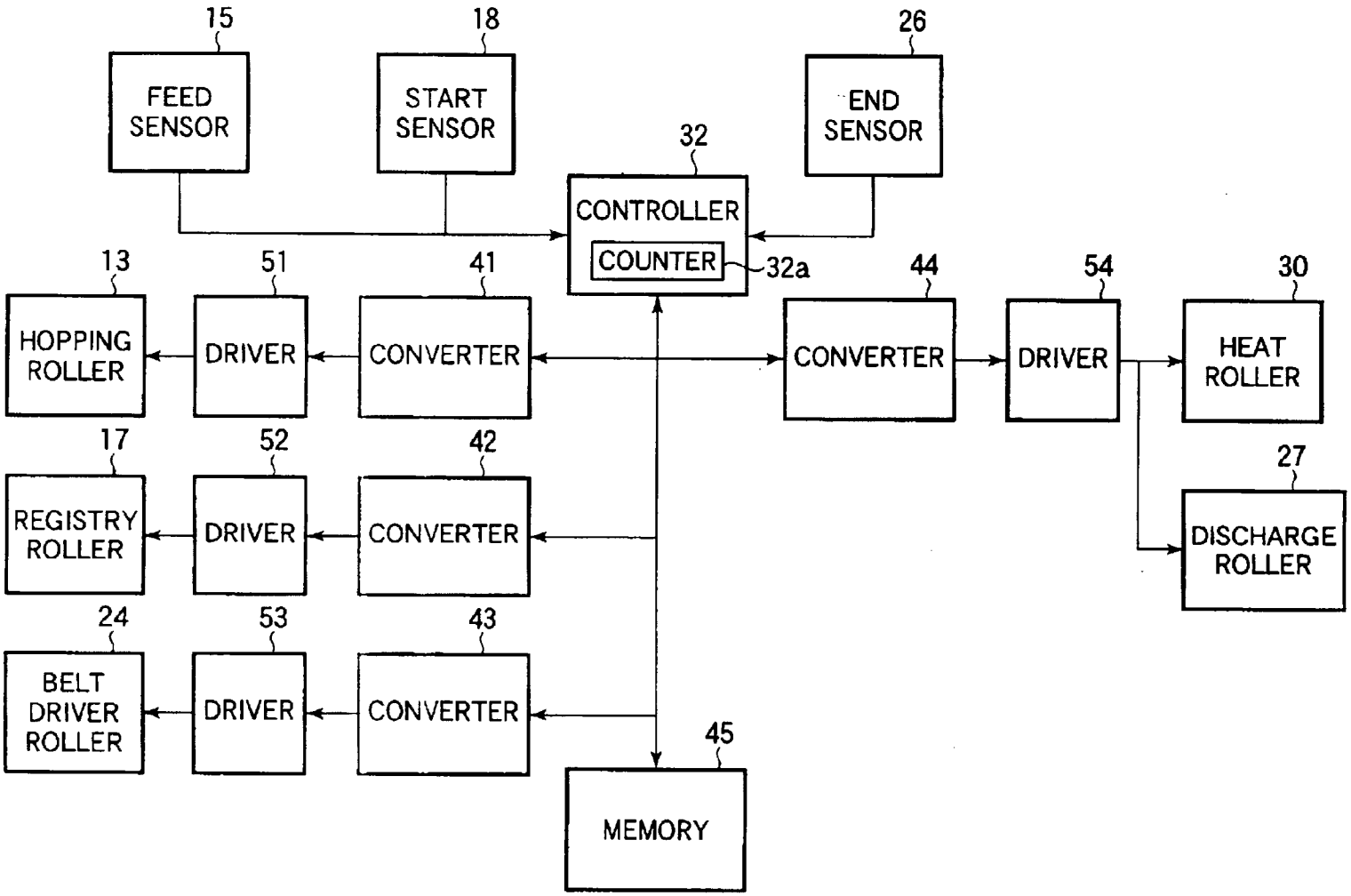
FIG. 2 is a block diagram of a printer according to the first embodiment.

FIG. 2 is a block diagram of a printer according to the first embodiment.

Referring to FIG. 1, a multi-purpose cassette 11 holds a stack of print medium such as paper and transparency.

When the printer is in a standby condition, the leading end of the stack of print medium 12 is raised by a hopping plate 14 so that the leading end of the top page of the stack is in pressure contact with a hopping roller 13.

A feed sensor 15 is disposed between the registry roller 17 and the hopping roller 13, and detects the leading end of the print medium 12 to generate a detection signal. The detection signal is sent to the controller 32. The registry roller 17 rotates in contact with a pinch roller 16 to feed the print medium 12 to a transport belt 23. The print medium 12 is placed on the transport belt 23, passing through transfer points defined by the photoconductive drums 19BK 19Y, 19M, and 19C and corresponding transfer rollers 20K, 20Y, 20M, and 20C. Then, the print medium 12 passes through a fixing unit 25. The fixing unit 25 includes a heat roller 30 and a backup roller 31 in pressure contact with the heat roller 30. When the print medium 12 passes through the fixing unit 25, the heat roller 30 applies heat to the toner image on the print medium 12 and the backup roller 31 applies pressure to the toner image, thereby fusing the toner image into the print medium 12. Then, the print medium 12 is pulled in between a discharging roller 27 and a pinch roller 28 to be discharged into a stacker 29. The print medium 12 travels over a distance Lt=500 mm from the start sensor 18 to the fixing unit 25.

The discharge roller 27 rotates in synchronism with the heat roller 30. An end sensor 26 is disposed between the fixing unit 25 and the discharge roller 27 to detect the trailing end of the print medium 12 when the print medium 12 is discharged into the stacker 29.

Upon a print command, the controller 32 generates first data used for the hopping roller 13 to feed the print medium 12 from the multi-purpose cassette 11 into the printer. The first data is sent to a first converter 41, which in turn converts the first data into pulses used for driving a drive source 51. The drive source 51 is driven by the pulses to rotate the hopping roller 13.

Upon receipt of the detection signal from the feed sensor 15, the controller 32 generates second data for transporting the print medium 12 from the hopping roller 13 to the registry roller 17. The second data is sent to the first converter 41. Then, the converter 41 converts the second data into pulses to control the drive source 51 to further rotate the hopping roller 13, thereby advancing the print medium 12 to the registry roller 17 and pinch roller 16.

Then, the controller 32 generates third data for advancing the print medium 12 from the registry roller 17 and pinch roller 16 to the transport belt 23. The third data is sent to a second converter 42. Then, the second converter 42 converts the third data into pulses to rotate the registry roller 17. The pulses are sent to a drive source 52, which in turn causes the registry roller 17 to rotate.

Upon receiving the detection signal from the start sensor 18, the controller 32 generates fourth data based on which the transport belt 23 advances the print medium 12. The fourth data is sent to a converter 43, which in turn converts the fourth data into pulses to drive a drive source 53. The drive source 53 is then driven by the pulses to drive the belt drive roller 24, so that the transport belt 23 runs along the row of the photoconductive drums 19BK, 19Y, 19M, and 19C.

Disposed around each photoconductive drum are a charging unit, an exposing unit, a developing unit, and a cleaning unit, not shown. The charging unit charges the surface of the photoconductive drum uniformly. Each image forming section performs an electrophotographic process including charging, exposing, developing, transferring and cleaning.

Referring to FIG. 2, shortly after activation of printing, the controller 32 reads fifth data from a memory 45 and sends the fifth data to a converter 44. The fifth data describes the length Lm of print medium 12 and is used for advancing the print medium 12 by means of the heat roller 30 toward the stacker 29.

The converter 44 converts the fifth data into pulses that control a drive source 54. The drive source 54 drives the heat roller 30 in rotation by a rotation amount specified by the number of pulses, thereby discharging the print medium 12 through the fixing unit 25.

Upon receiving a detection signal from an end sensor 26, the controller 32 generates sixth data for discharging the print medium 12 out of the printer. The sixth data is sent to a converter 44, which in turn converts the sixth data into pulses that controls a drive source 54. The drive source 54 then drives the discharge roller 27 in rotation, thereby discharging the print medium 12 out of the printer.

The print medium 12 is discharged face up onto the stacker 29. The heat roller 30 and discharge roller 27 are rotated through a sufficient number of rotations to completely discharge the print medium 12, and are then stopped.

When printing is performed on a long print medium, the print medium 12 may have a large amount of slack therein during transportation if the print medium 12 is fed to the fixing unit 25 at a speed slightly higher than the circumferential speed of the heat roller 30. As a result, a large amount of slack may cause the print medium 12 to contact the chassis of the fixing unit 25 inadvertently, so that the toner image formed on the print medium is broken. This results in poor print quality.

In the first embodiment, the rotational speed of the heat roller 30 is changed to transport the print medium 12 at a different discharge speed Vd to prevent the print medium 12 from having a large amount of slack.

The controller 32 changes the discharge speed Vd in accordance with a discharge distance Ld over which the leading edge of print medium 12 has traveled from a nip created between the heat roller 30 and the backup roller 31 toward stacker 29. For this purpose, the heat roller 30 is rotated at rotational speeds increased stepwise as the print medium 12 passes through the fixing unit 25. The discharge speed Vd is increased in a stepwise fashion at points $P_1$, $P_2$, and $P_3$ (FIG. 3), i.e., when the print medium 12 has traveled distances Ld=400 mm, 600 mm, and 800 mm, respectively, from the nip between the heat roller 30 and the backup roller 31.

Thus, when the print medium 12 reaches points $P_1$, $P_2$, and $P_3$, the discharge speed Vd is changed with respect to a reference speed Vs by predetermined values of the speed ratio $\gamma$.

Figure 3:
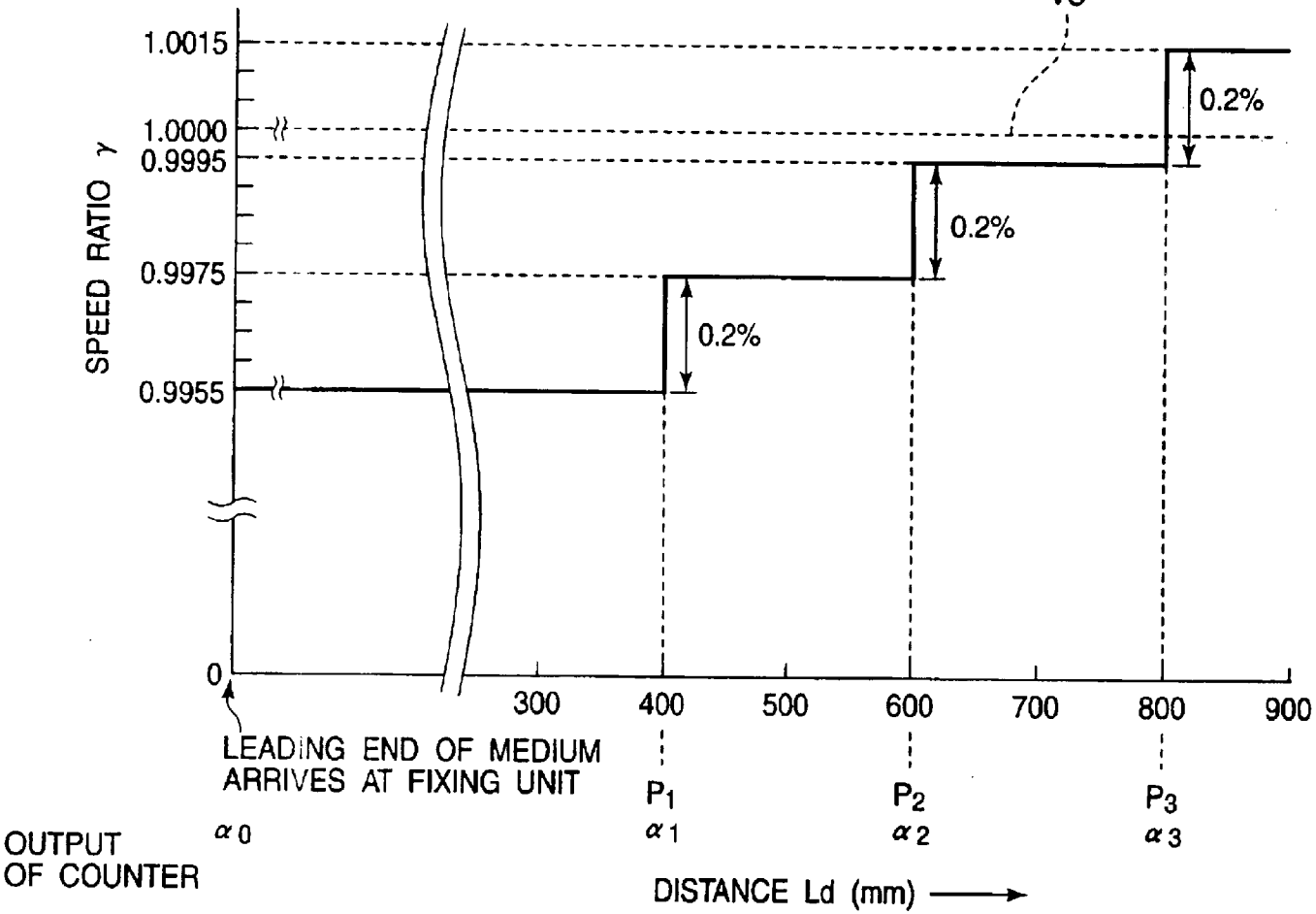
FIG. 3 illustrates the relationship between the discharge distance and the speed ratio.

FIG. 3 illustrates the relationship between the discharge distance Ld and the speed ratio $\gamma$. FIG. 3 plots Ld as the abscissa and $\gamma$ as the ordinate.

Referring to FIG. 3, when the discharge distance Ld in millimeters is in the range of $0 \leqq Ld \leqq 800$, the speed ratio $\gamma$ is smaller than 1.0000 and the discharge speed Vd is lower than the reference speed Vs. When the discharge distance Ld is in the range of $800 \leqq Ld$, the speed ratio $\gamma$ is larger than 1.0000 and the discharge speed Vd is higher than the reference speed Vs. The speed ratio $\gamma$ is increased progressively by 0.20%, as the leading end of the print medium 12 reaches points $P_1$, $P_2$, and $P_3$, respectively.

When the discharge distance Ld is in the range of $0 \leqq Ld \leqq 400$, the $\gamma$ is 0.9955. When the discharge distance Ld is in the range of $400 \leqq Ld \leqq 600$, the $\gamma$ is 0.9975. When the discharge distance Ld is in the range of $800 \leqq Ld$, the $\gamma$ is 1.0015. The initial value $\gamma$ x is 0.9955.

The initial value $\gamma$ x is such that the print medium 12 has no significant slack therein regardless of the medium thickness.

The operation of the controller 32 will now be described with reference to FIGS. 4–6.

Figure 4:
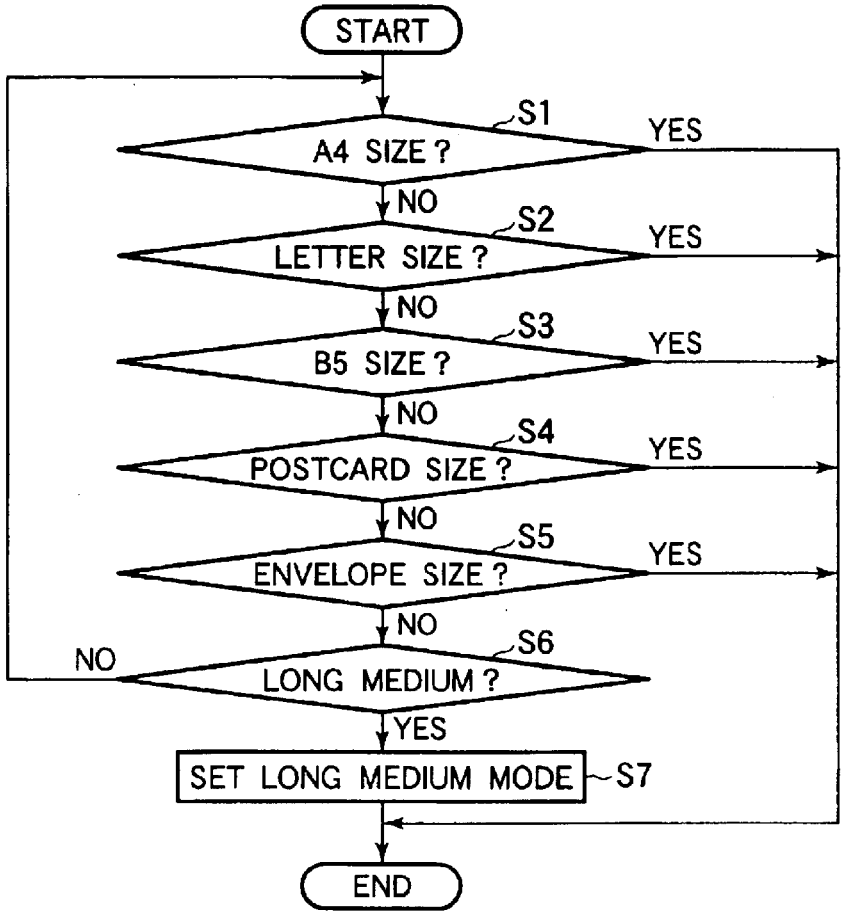
FIG. 4 is a flowchart, illustrating a medium-size determining operation according to the first embodiment.

FIG. 4 is a flowchart, illustrating a medium-size determining operation according to the first embodiment.

The operator places a stack of long medium in the multipurpose cassette 11 (FIG. 1) and operates the operation panel, not shown, to input information indicative of a long medium. The controller 32 carries out the medium-size determining process (FIG. 4) to detect the medium size inputted by the operator. The process determines whether the print medium 12 is of A4 size (51), letter size (52), B5 size (53), postcard size (54), or envelope size (55). If the print medium 12 is none of these sizes, then the process determines whether the print medium 12 has a long medium size (56). If the print medium 12 has a long medium size (YES at 56), the controller selects a long medium mode (57). In the specification, the term long medium size is used to cover a medium that has a length larger than that of any of the aforementioned mediums, i.e., longer than 600 mm (e.g., 900 mm, 1200 mm).

Figure 5:
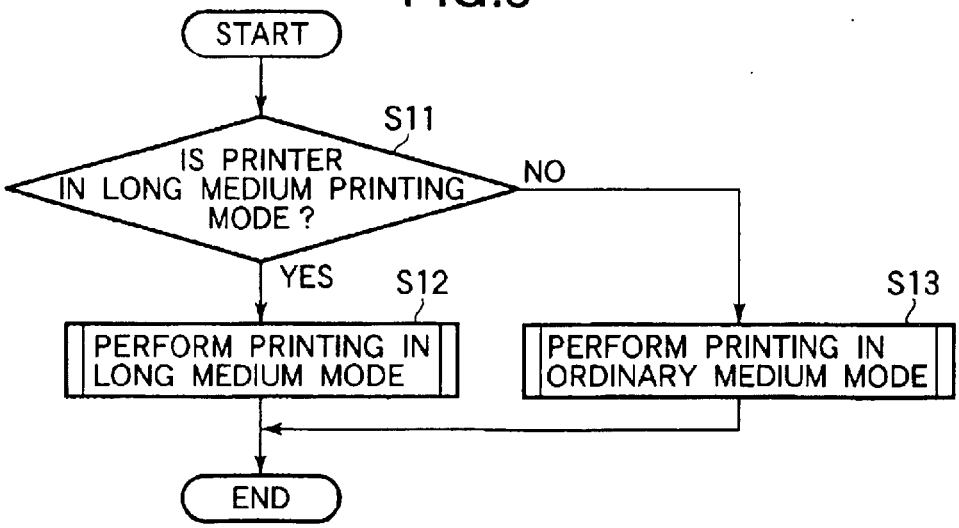
FIG. 5 is a flowchart, illustrating a print mode setting operation.

FIG. 5 is a flowchart, illustrating a print mode setting operation.

The controller 32 performs the print setting process (step S11, FIG. 5) in which a check is made to determine whether the long medium mode is selected. If the long medium mode is selected (YES at step S11), the controller 32 performs printing in the long medium mode (step S13). If the long medium mode is not selected (NO at step S12), the controller 32 performs printing in an ordinary-medium mode (step S13).

Figure 6:
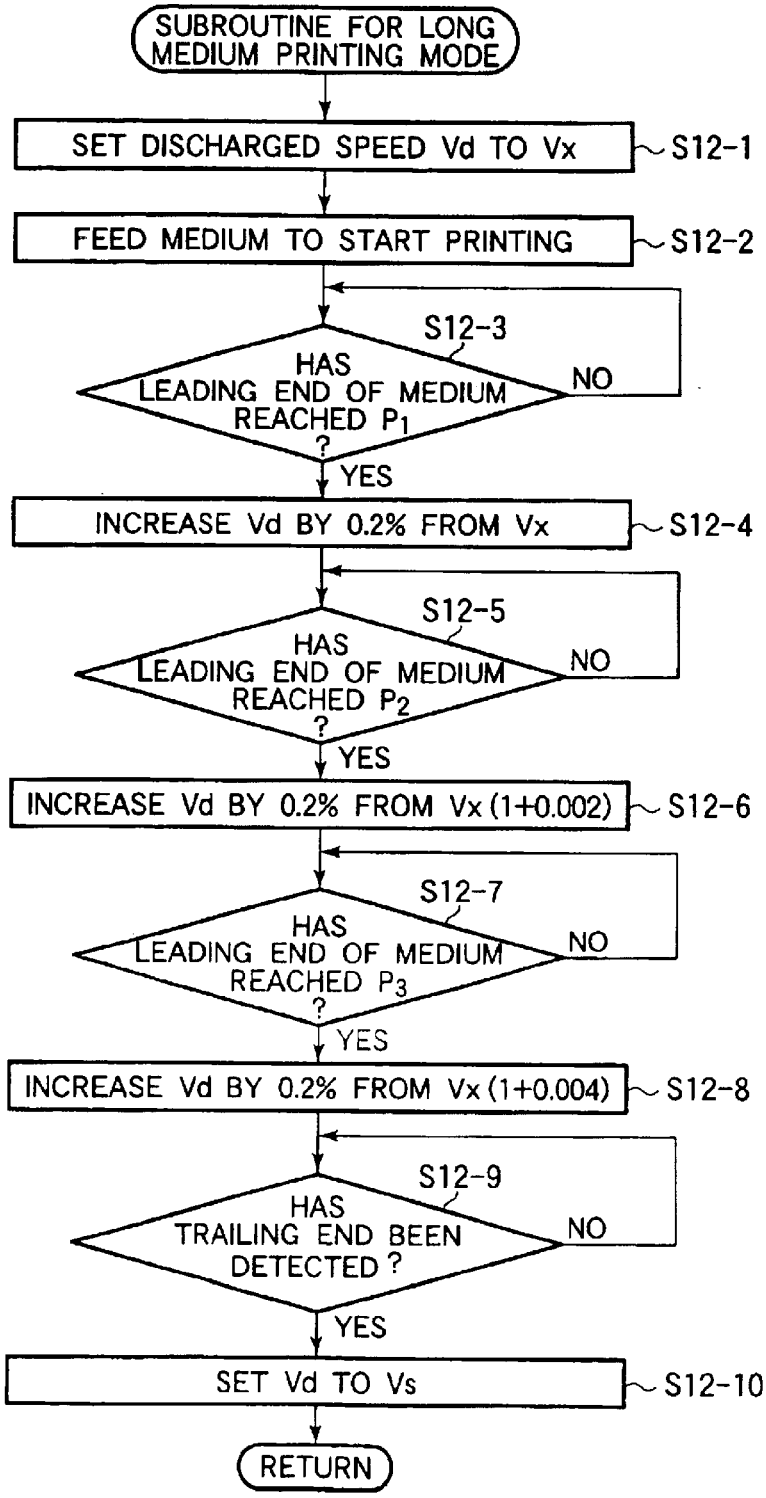
FIG. 6 is a subroutine for the long-medium mode in which printing is performed on a long print medium.

FIG. 6 is a subroutine for the long-medium mode in which printing is performed on a long print medium.

The long-medium mode will be described with reference to FIG. 6. If the long medium mode has been selected, the controller 32 sets the speed ratio $\gamma$ to the initial value $\gamma$ x (i.e., 0.9955) and the discharge speed Vd to an initial value Vx for the long medium mode, Vx being Vx=0.9955 Vs Then, printing is initiated so that the hopping roller 13 rotates to feed the print medium 12 into the printer. The start sensor 18 detects the leading end of the print medium 12 and sends the detection signal to the controller 32. The controller 32 includes a counter 32*a* that takes the form of a memory area in which the number of the rotational pulses is overwritten. The counter 32*a* counts the rotational pulses of the drive source sent to the converter 43, the pulses being representative of the medium length Lm.

Upon receiving the fifth data, the converter 43 converts the fifth data into the pulses, which in turn are sent to the drive source 53 and the controller 32. The controller 32 converts the number of rotational pulses into an amount of travel of the print medium 12, thereby calculating the length Lm of long medium that is transported from the start sensor 18 into the printer.

When the counter 32*a* counts up to a value $\alpha$ 0 indicating that the leading end of the print medium 12 has traveled over a distance Lt to reach the fixing unit 25, the controller 32 controls the drive source 54 so that the discharge speed Vd is equal to the initial value Vx=0.9955 Vs at step S12-1. Then, the discharge of the print medium 12 is begun (at step S12-2).

At step S12-3, when the counter 32*a* counts up to a value $\alpha$ 1 indicating that the leading end of the print medium 12 traveled 400 mm from the fixing unit 25 to reach point $P_1$, the controller 32 increases the discharge speed Vd by 0.20% from the reference Vx at step S12-4.

At step S12-5, when the counter 32*a* counts up to a value $\alpha$ 2 indicating that the leading end of the print medium 12 further travels over 200 mm to reach point $P_2$, the controller 32 increases the discharge speed Vd by 0.20% from Vx(1+0.002) at step S12-6.

At step S12-7, when the counter 32*a* counts up to a value $\alpha$ 3 indicating that the leading end of the print medium 12 further travels over 200 mm to reach point $P_3$, the controller 32 increases the discharge speed Vd by 0.20% from Vx(1+0.004) at step S12-8.

When the end sensor 26 detects the trailing end of the print medium 12 at step S12-9, the controller 32 sets the discharge speed Vd to the reference speed Vs at step S12-10.

As described above, the discharge speed Vd is increased as the medium length Lm increases. The discharge speed Vd is also increased as the output of the counter 32*a* increases. Increasing the discharge speed Vd in this manner prevents the print medium from having an excess slack therein.

In the embodiment, the discharge speed Vd can be automatically changed only in accordance with the output of the counter 32*a* that counts the rotational pulses, eliminating the need for manually setting the medium length Lm from the operation panel.

The stepwise increases of the discharge speed Vd after the print medium has passed the fixing unit 25 prevents not only the color shift of toner image on the print medium 12 but also insufficient developing, transferring, and medium discharging.

The paper discharging operation can be simplified by setting the initial speed ratio $\gamma$ x to a value less than 1.0000 and increasing little by little so that the speed ratio $\gamma$ exceeds 1.0000.

{Modification}

If the medium length Lm is over 1200 mm, the speed ratio $\gamma$ may be changed in such a way that the discharge speed Vd is increased and decreased repetitively after the print medium 12 has been transported through the fixing unit 25 over a discharge distance Ld=1200 mm.

Figure 7:
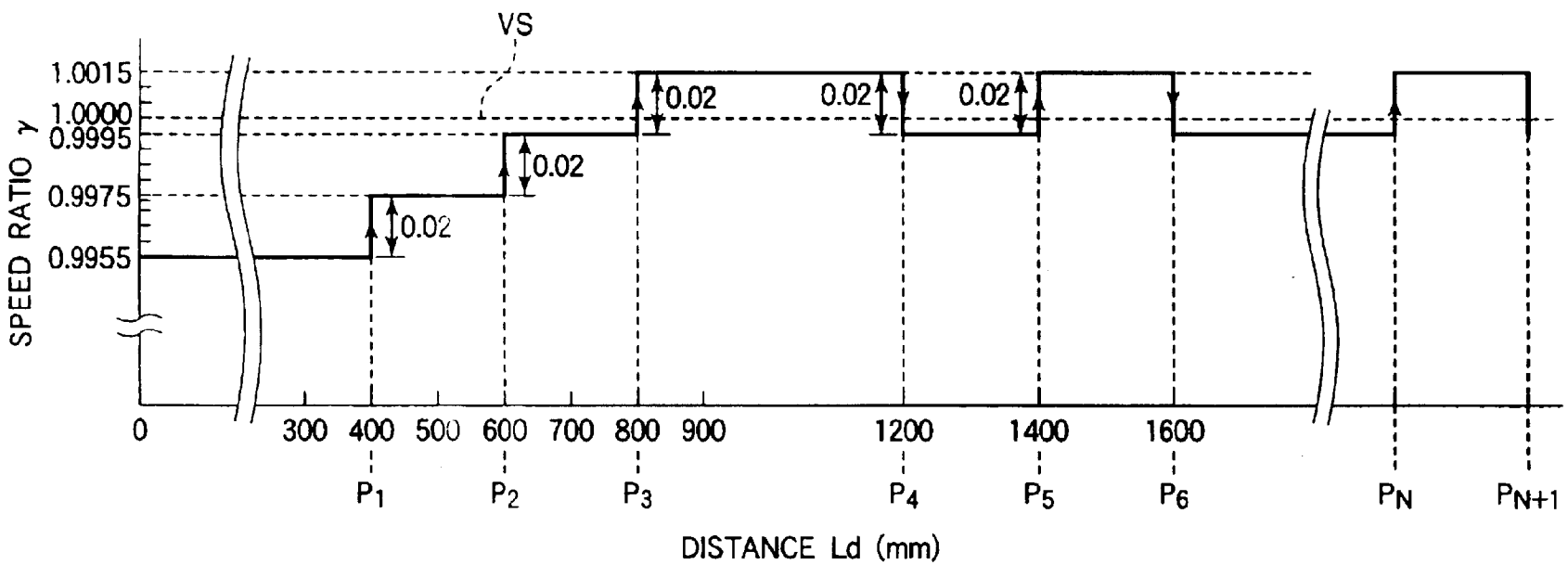
FIG. 7 illustrates the relationship between the discharge distance and the speed ratio.

FIG. 7 illustrates the relationship between the discharge distance Ld and the speed ratio $\gamma$.

Figure 8:
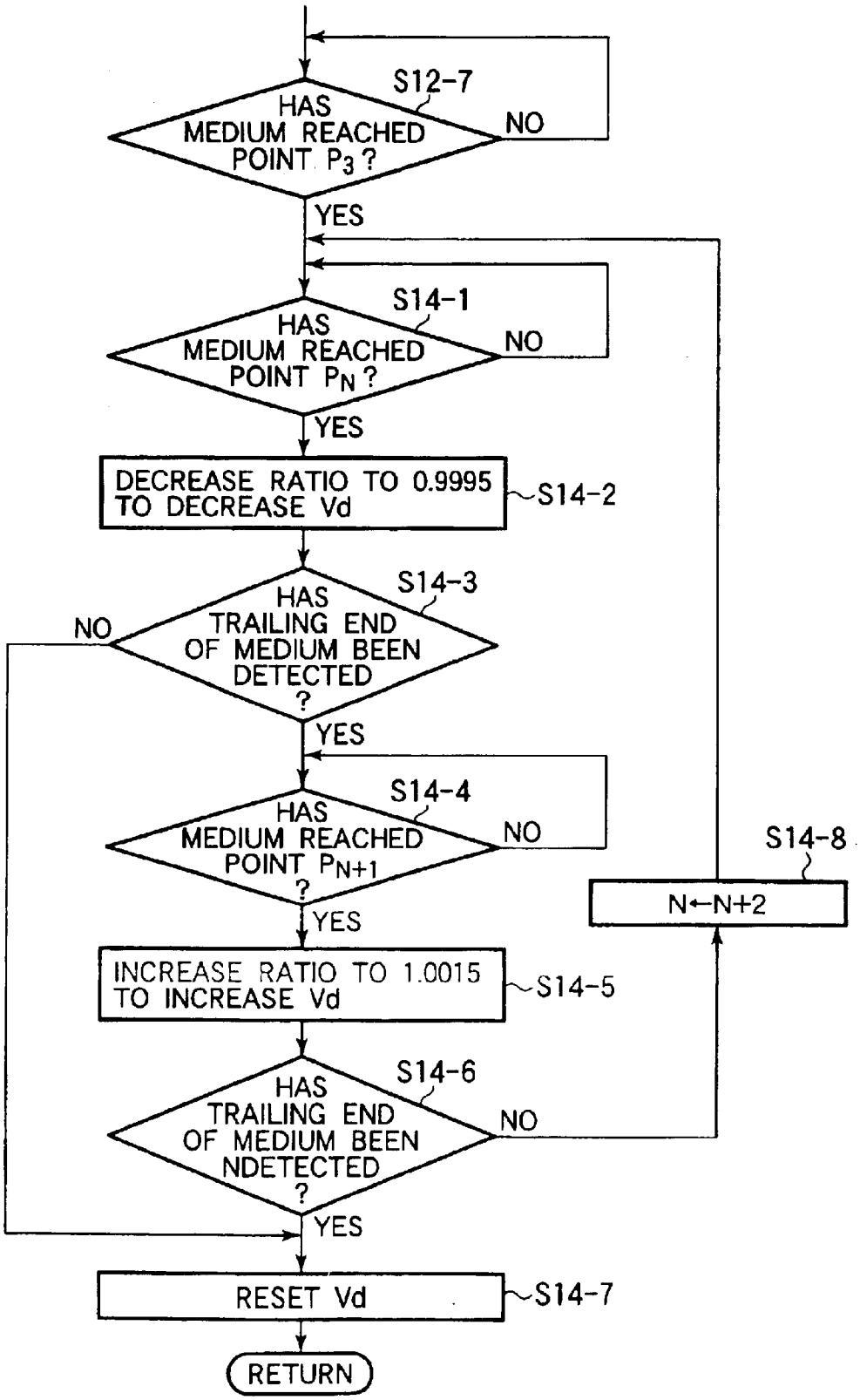
FIG. 8 is a flowchart, illustrating the operation of changing the discharge speed up and down repetitively after the discharge speed has reached to a maximum value.

FIG. 8 is a flowchart, illustrating the operation of changing the discharge speed Vd up and down repetitively after the discharge speed has reached to a maximum value.

Just as in the long-medium mode described with reference to FIG. 6, the discharge speed Vd is increased stepwise by the speed ratios $\gamma$ with respect to the reference speed Vs at points $P_1$, $P_2$, and $P_3$. The operation of the modification is the same as the first embodiment except for steps S12-8 to S12-10 shown in FIG. 6, and therefore only steps different from the first embodiment will be described.

The operation of the modification will be described with reference to FIGS. 7 and 8.

Referring to FIG. 8, at step S12-7, a check is made to determine whether the leading end of the print medium 12 has reached the third point $P_3$. If YES at step S12-7, the print medium continues to be advanced. When the print medium reaches a point P4, the speed ratio γ is decreased to 0.9995. Thereafter, the speed ratio γ is increased and decreased alternately at points $P_5$ and $P_6$, until point P is reached. At step S14-1, a check is made to determine whether the print medium 12 has reached point $P_N$. If YES at step S14-1, the program proceeds to step S14-2 where the speed ratio y is decreased to 0.9995 to decrease the discharge speed Vd. Then, the program proceeds to S14-3 where a check is made to determine whether the trailing end of the print medium has been detected. If YES at step S14-3, the program proceeds to step S14-4 where a check is made to determine whether the print medium 12 has reached point $P_{N+1}$. If NO at step S14-3, then the program jumps to step S14-7 where Vd is reset. If YES, at step S14-5 where the speed ratio y is increased to 1.0015 to increase the discharge speed Vd. Then, the program proceeds to step S14-6 where a check is made to determine whether the trailing end of print medium 12 has been detected. If YES at step S14-6, the program proceeds to step S14-7 where Vd is reset. If NO at step S14-6, then the program proceeds to step S14-8 where 2 is added to N. The initial value of N is 2. Then, the program jumps back to step S14-1. The modification has an advantage that the print medium is not taut nor does it have slack in it during the long medium mode. Moreover, repetitive changing the discharge speed Vd up and down as the print medium is discharged toward the paper stacker allows adjustment of taut and slack in the print medium between the transfer unit and the fixing unit. The modification may also be applied to second, third, and fourth embodiments which will be described later.

Second Embodiment

The printer according to a second embodiment has substantially the same construction as that according to the first embodiment and differs only in the medium-discharging operation.

FIG. 9 is a flowchart, illustrating the medium-discharging operation according to the third embodiment.

In the second embodiment, the controller 32 performs the medium-discharging operation for a long medium without a command indicative of a long medium inputted by the operator. In other words, the controller 32 performs the setup for printing where the length Lm of print medium 12 is detected and a check is made to determine whether the print medium 12 is a long medium.

The controller 32 performs the medium discharging operation in which the speed ratio γ is set to 1.0000 and the discharge speed Vd is set to the reference speed Vs. The hopping roller 13 is rotated to feed the print medium 12. When the start sensor 18 detects the leading edge of the print medium 12, the counter 32*a* in the controller 32 receives the rotational pulses from the converter 43 (FIG. 2) and counts the pulses.

The controller 32 checks the output of the counter 32*a* to determine whether the length Lm of the print medium is equal to or less than a predetermined value β 1 (step S21). In this embodiment, a medium having a length greater than β 1 is assumed to be a long medium. If the start sensor 18 detects the trailing end of the print medium 12 before the output of the counter 32*a* becomes β 1, then it is determined that the length Lm of the print medium 12 is equal to or less than β 1 and therefore the print medium is not long. Then, the controller 32 performs printing in the normal medium mode (step S22). The controller 32 sets the speed ratio γ to 1.0000 and transports the print medium 12 at a discharge speed Vd=Vs.

If the count of the counter 32*a* is more than β 1 when the print medium travels 400 mm after the start sensor 18 detects the trailing end of the print medium 12, then the controller 32 determines that the print medium 12 is longer than β 1 and therefore is a long medium. The steps S23 to S33 are the same as steps S12-1 to S12-10 and therefore the description thereof is omitted.

While the second embodiment has been described with respect to a case where the setting β 1 indicative of the print medium 12 is preset, the setting β 1 maybe set to an arbitrary value by the operator. For that purpose, the parameters for long-mediums are stored in a firmware, so that the operator operates the operation panel to set desired parameters.

Third Embodiment

The printer according to a third embodiment has substantially the same construction as that according to the first embodiment and differs only in the medium-discharging operation.

FIG. 10 illustrates medium discharge modes according to the third embodiment.

There are provided three discharge modes for long print mediums. Parameter data that constitute different discharge modes are stored in the memory (FIG. 2). The operator accesses these discharge modes from the operation panel, not shown, to set a desired discharge mode.

The first discharge mode includes an initial value γ x of 0.9900, an increment Δ γ of 0.30% at points $P_1$, $P_2$, and $P_3$, respectively, and Ld at points $P_1$, $P_2$, and $P_3$ of 300 mm, 500 mm, and 700 mm.

The second discharge mode includes an initial value γ x of 0.9955, an increment Δ γ of 0.20% at points $P_1$, $P_2$, and $P_3$, respectively, and Ld at points $P_1$, $P_2$, and $P_3$ of 400 mm, 600 mm, and 800 mm.

The third discharge mode includes an initial speed ratio γ x of 0.9990, an increment Δ γ of 0.10% at points $P_1$, $P_2$, and $P_3$, respectively, and Ld at points $P_1$, $P_2$, and $P_3$ of 500 mm, 700 mm, and 900 mm.

A plurality of print patterns allows setting of optimum discharge speeds Vd for long mediums of various sizes.

Fourth Embodiment

The printer according to the fourth embodiment is of substantially the same construction as the first embodiment. The fourth embodiment allows setting of arbitrary parameters of discharge mode.

Figure 11:
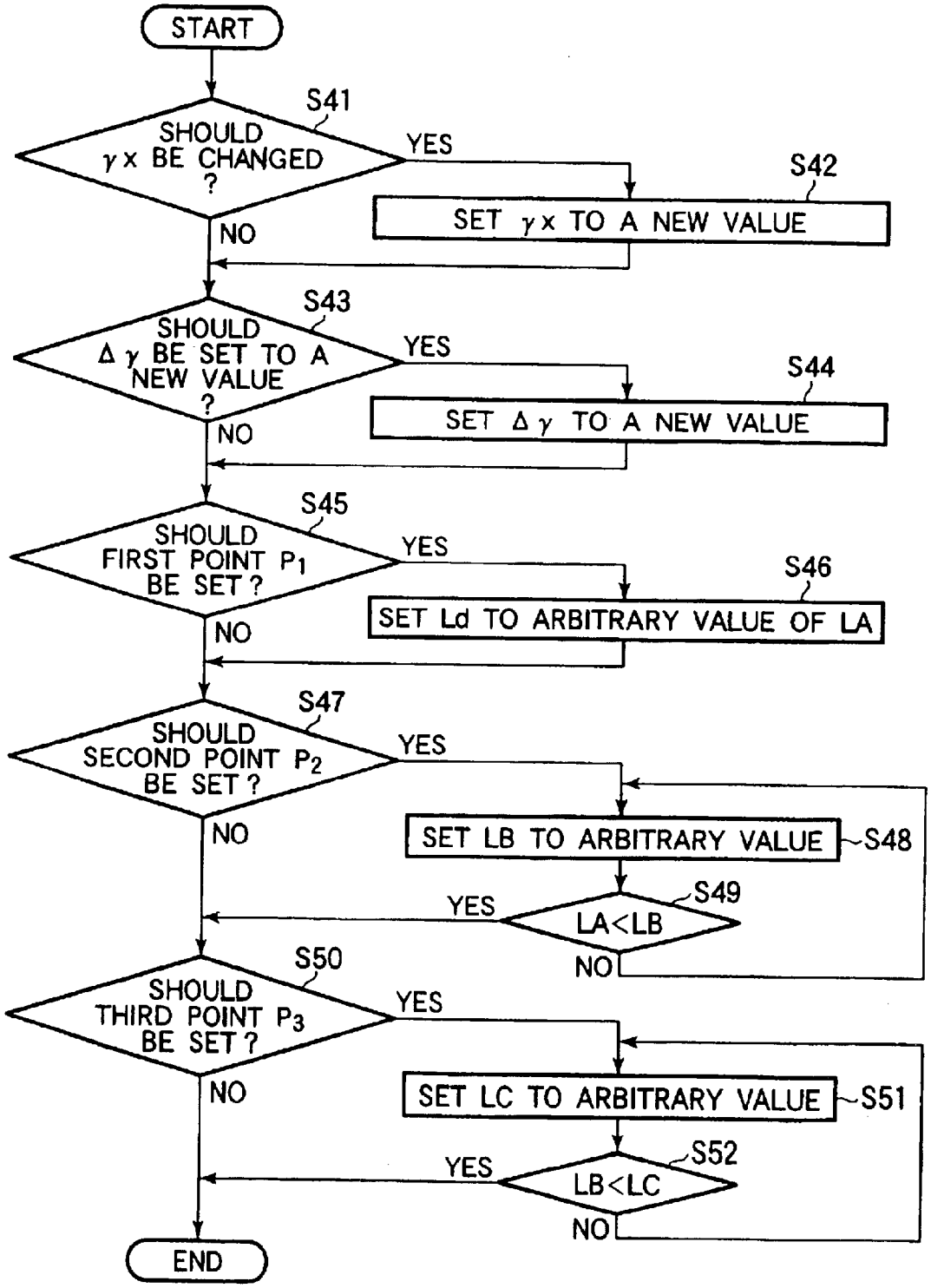
FIG. 11 is a flowchart, illustrating the setting of parameters of discharge mode according to the fourth embodiment.

FIG. 11 is a flowchart, illustrating the setting of parameters of discharge mode according to the fourth embodiment.

The operator operates the operation panel, not shown, to input an initial speed ratio γ x, an increment Δ γ at points $P_1$, $P_2$, and $P_3$ in FIG. 3 and discharge distance Ld at points $P_1$, $P_2$, and $P_3$ in FIG. 3.

Arbitrary parameters allow setting of optimum discharge speeds Vd for long mediums of various sizes.

The operation of the fourth embodiment will be described with reference to FIG. 3 and FIG. 11.

Referring to FIG. 11, at step S41, a check is made to determine whether the initial speed ratio γ x should be changed. If YES at step S41, the program proceeds to step S42 where the initial speed ratio γ x is set to a new value. If NO at step S41, the program proceeds to step S43 where a check is made to determine whether the increment Δ γ should be set to a new value. If YES at step S43, the program proceeds to step S44 where the increment Δ γ is set to a new value, the increment Δ γ being a fraction in percent of the reference speed Vs. If NO at step S43, the program proceeds to step S45 where a check is made to determine whether the first point $P_1$ should be set. If YES at step S45, the program proceeds to step S46 where Discharge distance Ld is set to an arbitrary desired value of LA. LA is a distance between points $P_0$ and $P_1$ in FIG. 3. If NO at step S45, the program proceeds to step S47 where a check is made to determine whether the second point $P_2$ should be set. If YES at step S47, the program proceeds to step S48 where LB is set to an arbitrary desired value, then the program proceeds to step S49 where a check is made to determine whether LA<LB. LB is a distance between points $P_1$, and $P_2$ in FIG. 3. If NO at step S49, the program jumps back to step S48 where another larger value of LB is set. If NO at step S47, the program proceeds to step S50 where a check is made to determine whether the third point should be set. If YES at step S50, then the program proceeds to step S51 where LC is set to an arbitrary desired value and then the program proceeds to step S52 where a check is made to determine whether LB<LC. LC is a distance between points $P_2$ and $P_3$ in FIG. 3. If NO at step S52, then the program jumps back to step S51 where another larger value of LC is set. If YES at step S52, the program ends.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that a relative speed of said first medium-transporting section and said second medium-transporting section is changed in accordance with a distance from a reference position over which the medium is advanced by said second medium-transporting section;

wherein said controller sets the second transport speed higher than the first transport speed when the medium has traveled over a distance longer than a predetermined length from the reference position.

2. The image recording apparatus according to claim 1, wherein if the medium has traveled over a predetermined distance after said controller sets the second transport speed higher than the first transport speed, said controller sets the second transport speed lower than the first transport speed.

3. The image recording apparatus according to claim 1, wherein said first medium-transporting section has a transfer section that transfers the toner image onto the medium, wherein said second medium-transporting section has a fixing section that fixes the toner image on the medium.

4. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that the first transport speed and the second transport speed are changed relative to each other in accordance with a distance from a reference position over which the medium is advanced by said second medium-transporting section;

wherein said controller determines whether the medium has a length greater than a predetermined medium length;

wherein said controller changes the second transport speed when the medium has a length greater than the predetermined medium length.

5. The image recording apparatus according to claim 4, further comprising a medium detector disposed in a transport path of the medium to detect the medium, and a counter that counts operation parameters of said first medium-transporting section after the medium is detected by said medium detector, wherein said controller checks an output of the counter to determine whether the medium is longer than the predetermined medium length.

6. The image recording apparatus according to claim 4, wherein said first medium-transporting section has a transfer section that transfers the toner image onto the medium, wherein said second medium-transporting section has a fixing section that fixes the toner image on the medium.

7. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that a relative speed of said first medium-transporting section and said second medium-transporting section is changed in accordance with a distance from a reference position over which the medium is advanced by said second medium-transporting section;

wherein said controller changes the second transport speed from a value lower than the first transport speed to a value higher than the first transport speed when the medium has traveled over a distance longer than a predetermined length from the reference position.

8. The image recording apparatus according to claim 7, wherein said first medium-transporting section has a transfer section that transfers the toner image onto the medium, wherein said second medium-transporting section has a fixing section that fixes the toner image on the medium.

9. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that a relative speed of said first medium-transporting section and said second medium-transporting section is changed in accordance with a distance from a reference position over which the medium is advanced by said second medium-transporting section;

wherein if the medium has traveled over a predetermined distance after said controller sets the second transport speed higher than the first transport speed, said controller changes the second transport speed from a value higher than the first transport speed to a value lower than the first transport speed.

10. The image recording apparatus according to claim 9, wherein said first medium-transporting section has a transfer section that transfers the toner image onto the medium, wherein said second medium-transporting section has a fixing section that fixes the toner image on the medium.

11. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that the first transport speed and the second transport speed are changed relative to each other in accordance with a distance from a reference position over which the medium is advanced by said second medium-transporting section;

wherein the distance is selected in accordance with a ratio of the first transport speed to the second transport speed.

12. The image recording apparatus according to claim 11, wherein said first medium-transporting section has a transfer section that transfers the toner image onto the medium, wherein said second medium-transporting section has a fixing section that fixes the toner image on the medium.

13. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that the first transport speed and the second transport speed are changed relative to each other in accordance with a distance from a reference position over which the medium is advanced by said second medium-transporting section;

wherein when said second medium-transporting section transports the medium, said controller first sets the second transport speed to a value lower than the first transport speed, and then increases the second transport speed in accordance with the distance.

14. The image recording apparatus according to claim 13, wherein said first medium-transporting section has a transfer section that transfers the toner image onto the medium, wherein said second medium-transporting section has a fixing section that fixes the toner image on the medium.

15. An image recording apparatus, comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section, so that the first transport speed and the second transport speed are changed relative to each other in accordance with a distance from a reference position over which the medium is advanced by said second medium-transporting section;

wherein at least one of the first transport speed and the second transport speed is controlled stepwise.

16. The image recording apparatus according to claim 15, wherein said first medium-transporting section has a transfer section that transfers the toner image onto the medium, wherein said second medium-transporting section has a fixing section that fixes the toner image on the medium.

17. An image recording apparatus comprising:

an image forming section that forms a toner image on a medium;

a first medium-transporting section that transports the medium onto which the toner image has been transferred;

a second medium-transporting section that receives the medium transported from said first medium transporting section, and further transports the medium, said second medium-transporting section being disposed downstream of said first medium-transporting section with respect to a direction of travel of the medium; and a controller that controls at least one of a first transport speed of said first medium-transporting section and a second transport speed of said second medium-transporting section when the medium is transported by both said first medium-transporting section and said second medium-transporting section simultaneously, wherein said controller controls the at least one of the first transport speed and the second transport speed in such a way that the first transport speed and the second transport speed are changed relative to each other in accordance with a distance from a reference position over which the medium is advanced by said second medium-transporting section.

18. The image recording apparatus according to claim 17, wherein said first medium-transporting section has a transfer section that transfers the toner image onto the medium, wherein said second medium-transporting section has a fixing section that fixes the toner image on the medium.

* * * * *